US007069992B2

(12) United States Patent
Lewis et al.

(10) Patent No.: US 7,069,992 B2
(45) **Date of Patent: *Jul. 4, 2006**

(54) MONO-TRIP CEMENT THRU COMPLETION

(75) Inventors: Keith E. Lewis, Bangkok (TH); Anthony James Orchard, Bangkok (TH); Joseph C. H. Yeo, Singapore (SG); Jim H. Kritzler, Pearland, TX (US); Walter R. Chapman, Kingwood, TX (US); James H. Holt, Conroe, TX (US)

(73) Assignee: Baker Hughes Incorporated, Houston, TX (US)

( * ) Notice: Subject to any disclaimer, the term of this patent is extended or adjusted under 35 U.S.C. 154(b) by 85 days.

This patent is subject to a terminal disclaimer.

(21) Appl. No.: 10/676,133

(22) Filed: Oct. 1, 2003

(65) Prior Publication Data

US 2004/0112606 A1 Jun. 17, 2004

Related U.S. Application Data

(60) Provisional application No. 60/415,393, filed on Oct. 2, 2002.

(51) Int. Cl.
*E21B 43/00* (2006.01)

(52) U.S. Cl. ..... 166/285; 166/177.4

(58) Field of Classification Search ..... 166/285, 166/117.5, 153, 177.4
See application file for complete search history.

(56) References Cited

U.S. PATENT DOCUMENTS

| | | | | |
|---|---|---|---|---|
| 2,923,357 | A | 2/1960 | Daffin | 166/102 |
| 3,014,533 | A | 12/1961 | Moore, Jr. | 166/224 |
| 3,050,121 | A | 8/1962 | Garrett et al. | 166/46 |
| 3,130,784 | A | 4/1964 | Pennington, II | 166/42 |
| 3,653,435 | A * | 4/1972 | Reistle et al. | 166/366 |
| 5,595,246 | A | 1/1997 | Voll et al. | 166/278 |
| 5,746,274 | A | 5/1998 | Voll et al. | 166/285 |
| 2002/0157827 | A1 | 10/2002 | Roddy et al. | 166/285 |

FOREIGN PATENT DOCUMENTS

GB 2325682 A 2/1998

* cited by examiner

*Primary Examiner*—William Neuder
(74) *Attorney, Agent, or Firm*—Madan, Mossman & Sriram, P.C.

(57) ABSTRACT

In systems and methods for production of hydrocarbons fluids from a formation surrounding a wellbore, a production assembly is cemented into place, and excess cement is then cleaned from the production tubing and liner. Thereafter, hydrocarbon fluids are produced and artificial gas lift assistance is provided. All of this may be accomplished in a single trip (mono-trip) of the production tubing.

27 Claims, 7 Drawing Sheets

MONO-TRIP CEMENT THRU COMPLETION

This application claims the priority of U.S. Provisional patent application Ser. No. 60/415,393 filed Oct. 2, 2002.

BACKGROUND OF THE INVENTION

1. Field of the Invention

The invention relates generally to systems and methods for cementing in a portion of a production liner to provide a wellbore completion, cleaning excess cement from the liner and other components, and thereafter producing hydrocarbons from the wellbore completion. In further aspects, the invention relates to systems for gas lift of hydrocarbons from a well.

2. Description of the Related Art

After a well is drilled, cased, and perforated, it is necessary to anchor a production liner into the wellbore and, thereafter, to begin production of hydrocarbons. Oftentimes, it is desired to anchor the production liner into place using cement. Unfortunately, cementing a production liner into place within a wellbore has been seen as foreclosing the possibility of using gas lift technology to increase or extend production from the well in a later stage. Cementing the production liner into place prevents the production liner from being withdrawn from the well. Because a completion becomes permanent when cemented, any gas lift mandrels that are to be used will have to be run in with the production string originally. This is problematic, though, since the operation of cementing the production liner into the wellbore tends to leave the gas inlets of a gas lift mandrel clogged with cement and thereafter unusable.

To the inventors' knowledge, there is no known method or system that permits a completion to be cemented into place and, thereafter, to effectively use gas lift technology to assist removal of hydrocarbons in only a single trip into the wellbore.

The present invention addresses the problems of the prior art.

SUMMARY OF THE INVENTION

The invention provides systems and methods for cementing in a production liner, and then effectively cleaning excess cement from the production tubing and liner. Additionally, the invention provides systems and methods for thereafter providing gas lift assistance for the production of fluids from the well. All of this is accomplished in a single trip (mono-trip) of the production tubing.

In a preferred embodiment, the production system of the present invention includes a central flowbore defined within a series of interconnected subs or tools and incorporates a mandrel for retaining gas lift valves. In a currently preferred embodiment, the gas lift valves are not placed into the mandrel until after the cementing and cleaning operations have been performed. The completion system preferably includes a lateral diverter, such as a shoe track, that permits cement pumped down the flowbore to be placed into the annulus of the well. Additionally, the completion system includes a wiper plug and, preferably, a means for landing the wiper plug within the flowbore. An exemplary completion system also features a valve that selectively permits the circulation of working fluid through the flowbore and annulus as well as the side pocket mandrel. In a preferred embodiment, the valve may be selectively opened and closed to provide for such circulation of working fluid to be started and stopped.

In a currently preferred embodiment, the present invention also provides a method of production wherein a completion system containing a side pocket mandrel is disposed into a wellbore. The completion system is then cemented into place by pumping cement into a flowbore in the completion system and diverting the cement into the annulus. The annulus is filled with cement to a predetermined level, and then a packer is set. In preferred embodiments, the packer is located proximate the level of the cement in the annulus. The formation is thereafter perforated using a wireline-run perforation device. Following cementing of the completion assembly, the completion assembly is cleaned of excess cement by driving a wiper plug through the flowbore of the completion assembly under impetus of pressurized working fluid. The working fluid will help to remove excess cement from the flowbore and the associated tools and devices that make up the completion system. Pressurized working fluid is also introduced into the annulus above the packer by opening a lateral port in a valve assembly. Thereafter, the valve assembly may be closed by increasing fluid pressure within the flowbore and annulus. Gas lift valves are then placed into the side pocket mandrel using a kickover tool. Production of hydrocarbons from the perforated formation can then occur with the assistance of the gas lift devices.

DETAILED DESCRIPTION OF THE PREFERRED EMBODIMENTS

Figure 1:
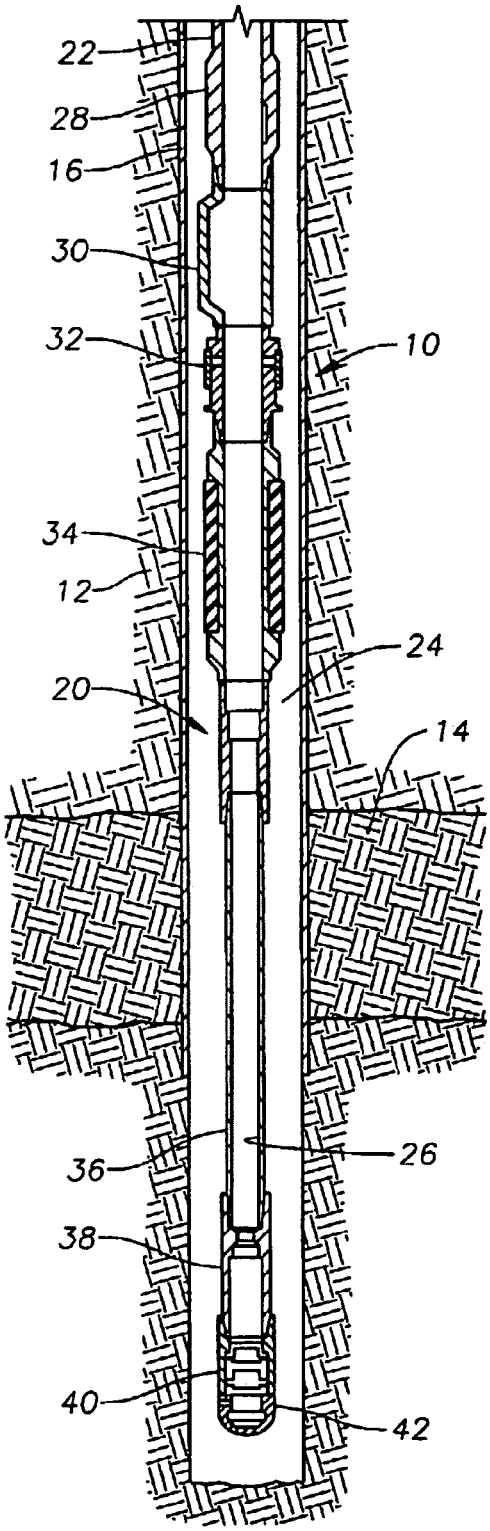
FIG. 1 is a side, cross-sectional view of an exemplary mono-trip production system constructed in accordance with the present invention having been landed in a wellbore.
Figure 2:
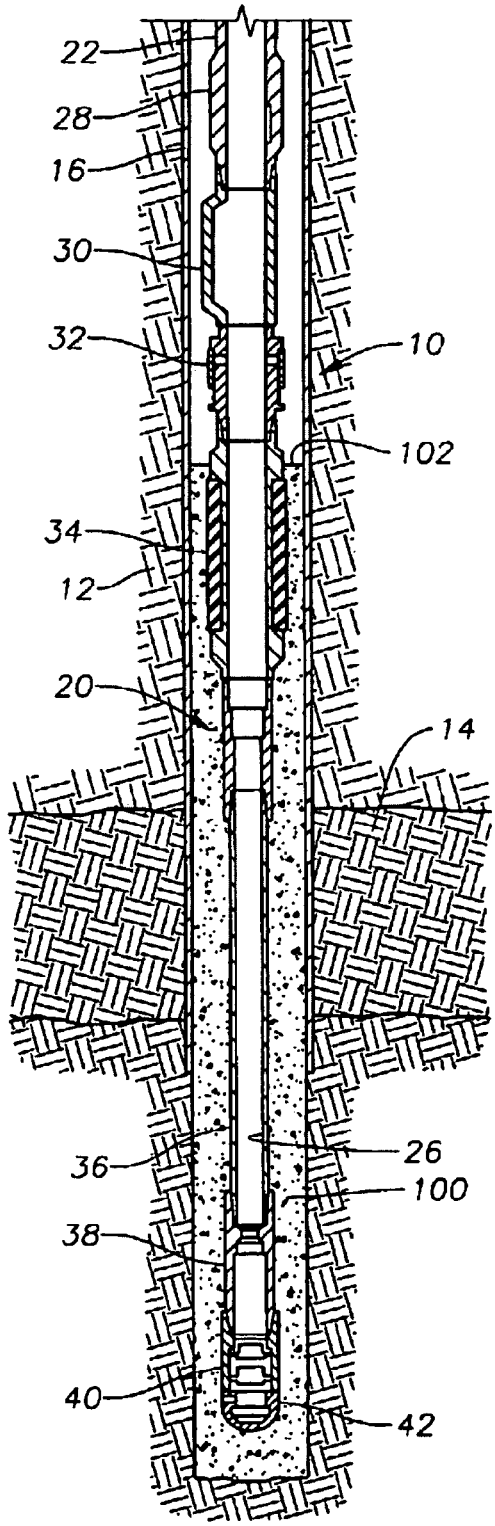
FIG. 2 is a side, cross-sectional view of the exemplary production system shown in FIG. 1 wherein cement has been flowed into the production system.

FIG. 1 schematically illustrates lower portions of a wellbore 10 that has been drilled into the earth 12. A hydrocarbon formation 14 is illustrated. The exemplary wellbore 10 is at least partially cased by metal casing 16 that has been previously cemented into place, as is well known. An exemplary mono-trip completion system or assembly, illustrated generally at 20, is shown suspended from production tubing 22 and disposed within the wellbore 10. An annulus 24 is defined between the completion system 20 and the wellbore 10. In addition, it is noted that the production tubing 22 and the completion system 20 define therewithin an axial flowbore 26 along their length.

The upper portions of the exemplary mono-trip completion system 20 includes a number of components that are interconnected with one another via intermediate subs. These components include a subsurface safety valve 28, a side-pocket mandrel 30, and a hydrostatic closed circulation valve (HCCV) 32. A packer assembly 34 is located below the HCCV 32. A production liner 36 extends below the packer assembly 34 and is secured, at its lower end, to a landing collar 38. A shoe track 40 is secured at the lower end of the completion system 20. The shoe track 40 has a plurality of lateral openings 42 that permit cement to be flowed out of the lower end of the flowbore 26 and into the annulus 24.

The subsurface safety valve 28 is a valve of a type known in the art for shutting off the well in case of emergency. As the structure and operation of such valves are well understood by those of skill in the art, they will not be described in any detail herein.

Figure 10A:
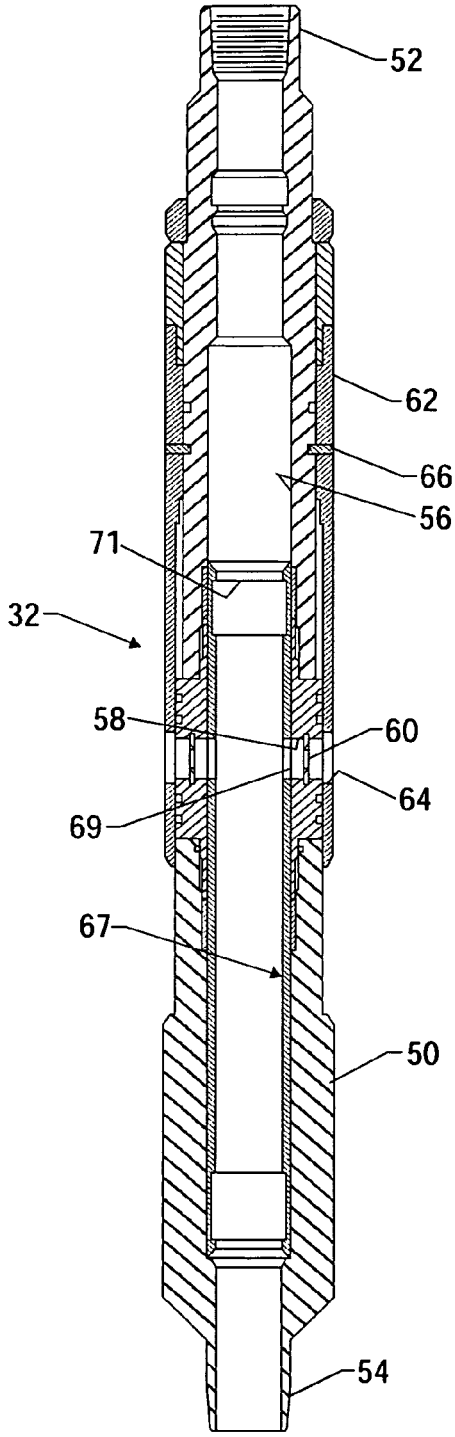
FIGS. 10A, 10B and 10C are detailed views of the hydrostatic closed circulation valve portion of the exemplary production system shown in FIGS. 1–7.
Figure 10B:
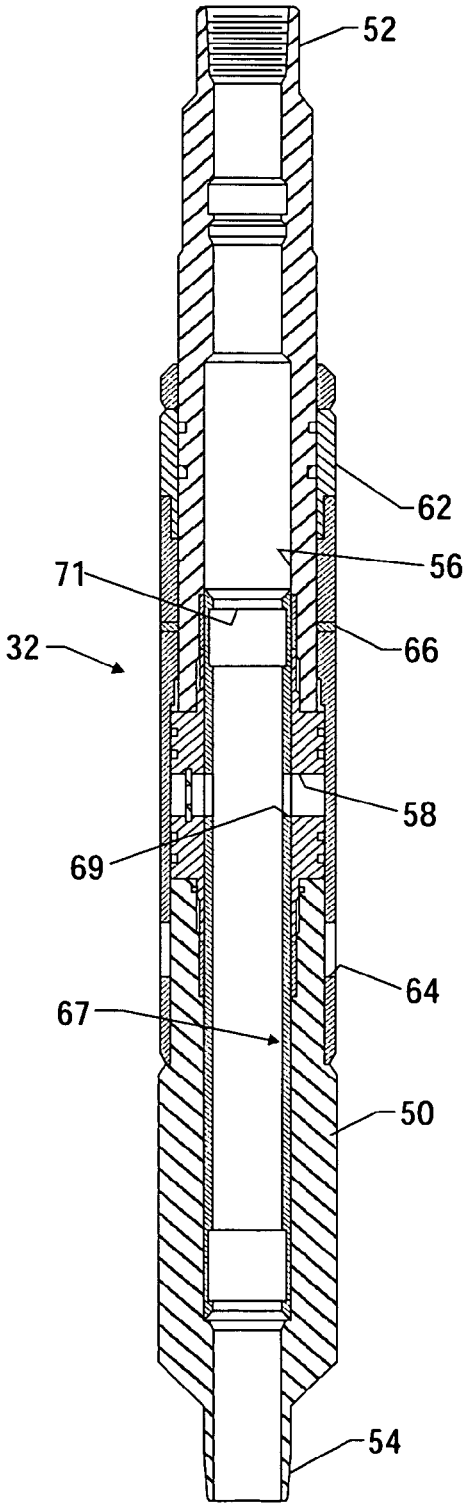
Figure 10C:
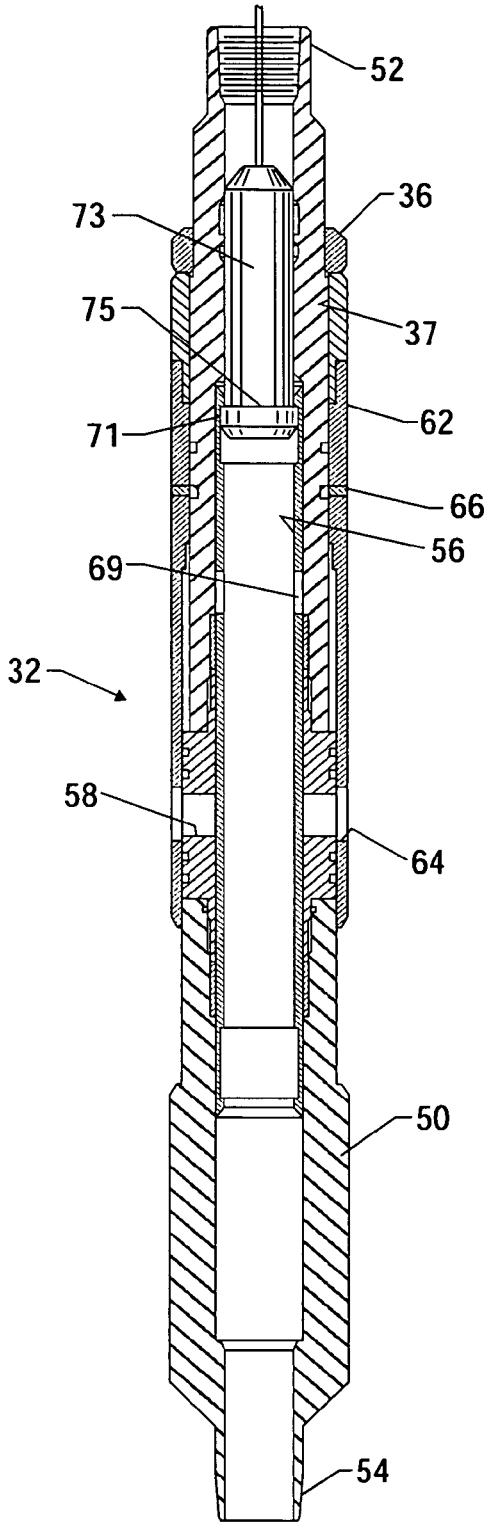

The hydrostatic closed circulation valve (HCCV) 32 is depicted in greater detail in FIGS. 10A, 10B and 10C. The HCCV 32 includes an inner mandrel 50 having threaded pin and box-type connections at either axial end 52, 54. The inner mandrel 50 defines an axial flowbore 56 along its length. A central portion of the inner mandrel 50 contains a lateral fluid port 58 through which fluid communication may occur between the flowbore 56 and the radial exterior of the inner mandrel 50. Initially, a rupture disk 60 closes the fluid port 58 against fluid flow. An outer sleeve 62 radially surrounds the inner mandrel 50 and is capable of axial movement upon the inner mandrel 50. A fluid opening 64 is disposed through the outer sleeve 62. A predetermined number of frangible shear pins 66 secures the outer sleeve 62 to the inner mandrel 50.

The HCCV 32 also includes an inner sleeve 67 that is located within the flowbore 56 of the inner mandrel 50. The inner sleeve 67 features a fluid aperture 69 that is initially aligned with the fluid port 58 in the inner mandrel 50. The upper end of the inner sleeve 67 provides an engagement profile 71 that is shaped to interlock with a complimentary shifting element. The inner sleeve 67 is also axially moveable within the flowbore 56 between a first position, shown in FIG. 10A, wherein the fluid aperture 69 is aligned with the lateral fluid flow port 58 of the inner mandrel 50, and a second position (shown in FIG. 10C) wherein the fluid aperture 69 is not aligned with the flow port 58. When the inner sleeve 67 is in the second position, fluid communication between the flowbore 56 and the exterior radial surface of the valve assembly 32 is blocked.

The HCCV 32 is actuated using pressure to provide for selective fluid flow from within the flowbore 56 to the annulus 24. Prior to running into the wellbore 10, the HCCV 32 is in the configuration shown in FIG. 10A with the outer sleeve 62 secured by shear pin 66 in an upper position upon the inner mandrel 50 so that the fluid opening 64 in the outer sleeve 62 is aligned with the fluid port 58 of the inner mandrel 50. Upon application of a first, suitable fluid pressure load within the flowbore 56, the rupture disk 60 will be broken, thereby permitting fluid to be communicated between the flowbore 56 and the radial exterior of the HCCV 32. Upon application of a second, suitably high exterior fluid pressure to the outer sleeve 62, the shear pin 66 will break, releasing the sleeve 62 to slide downwardly upon the inner mandrel 50 to a second axial position, depicted in FIG. 10B. In this position, the outer sleeve 62 covers the fluid port 58 of the inner mandrel 50. Fluid communication between the flowbore 56 and the annulus 24 will be blocked. In this manner, circulation of a working fluid through the valve assembly 32, other portions of the completion system 20, and the annulus 24 may be selectively started and stopped.

In the event of failure of the outer sleeve 62 to close, a wireline tool, shown as tool 73 in FIG. 10C, having a shifter 75, which is shaped and sized to engage the profile 71 of the inner sleeve 67 in a complimentary manner, is lowered into the flowbore 26 and flowbore 56 of the valve assembly 32. When the shifter 75 engages the profile 71, the shifter 75 is pulled upwardly to move the inner sleeve 67 to its second, closed position (shown in FIG. 10C) so that the opening 69 on the inner sleeve 67 is not aligned with the flow port 58 of the inner mandrel 50. In this position, fluid flow through the flow port 58 is blocked.

Figure 11:
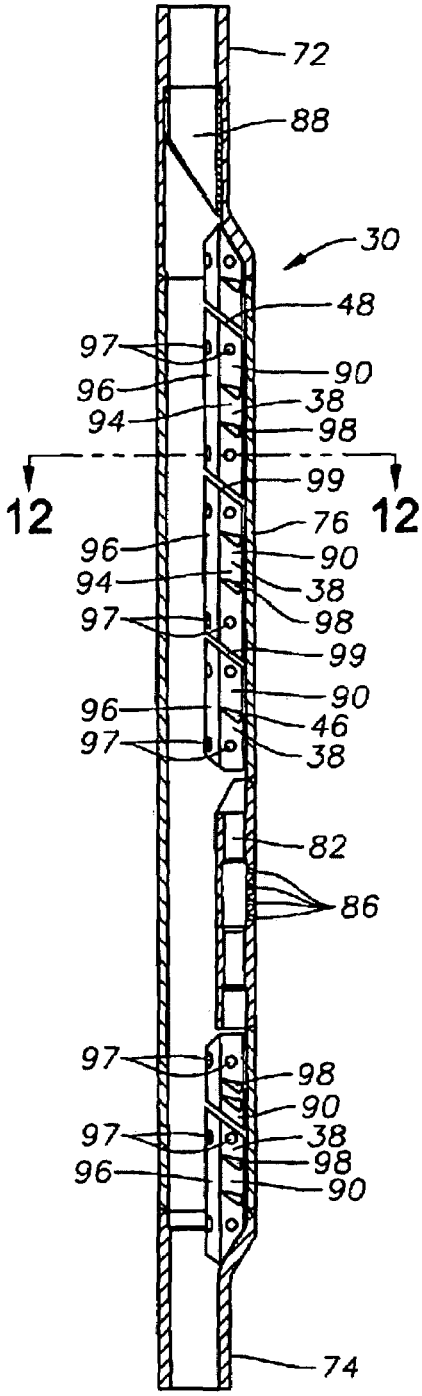
FIG. 11 is a side, cross-sectional view of an exemplary cement-thru side pocket mandrel used within the completion system.
Figure 12:
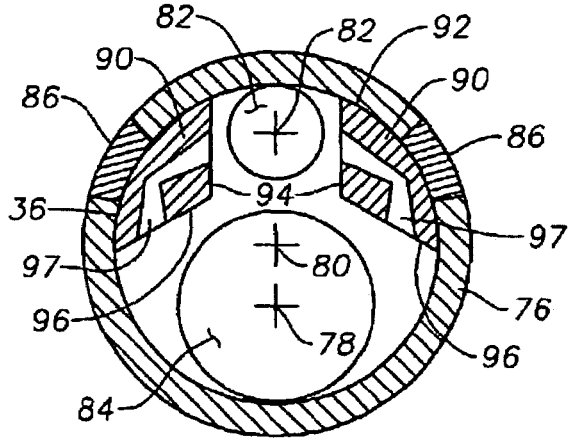
FIG. 12 is an axial cross-section taken along the lines 12—12 in FIG. 11.
Figure 13:
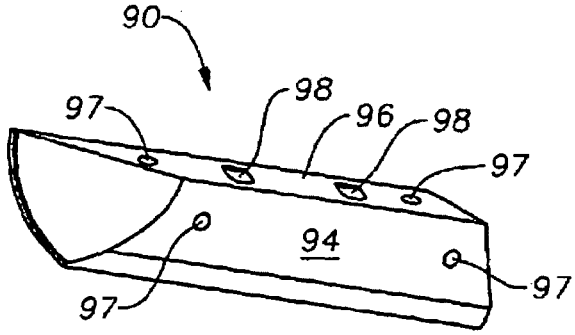
FIG. 13 is a detail view of a mandrel guide section.

The side pocket mandrel 30 is of the type described in our co-pending application 60/415,393, filed Oct. 2, 2002. The side pocket mandrel 30 is depicted in greater detail and apart from other components of the completion system in FIGS. 11, 12 and 13. The side pocket mandrel 30 includes a pair of tubular assembly joints 72 and 74, respectively, at the upper and lower ends. The distal ends of the assembly joints are of the nominal tubing diameter as extended to the surface and are threaded for serial assembly. Distinctively, however, the assembly joints are asymmetrically swaged from the nominal tube diameter at the threaded ends to an enlarged tubular diameter. In welded assembly, for example, between and with the enlarged diameter ends of the upper and lower assembly joints is a larger diameter pocket tube 76. Axis 78 respective to the assembly joints 72 and 74 is off-set from and parallel with the pocket tube axis 80 (FIG. 12).

A valve housing cylinder 82 is located within the sectional area of the pocket tube 76 that is off-set from the primary flow channel area 84 of the production tubing 22. External apertures 86 in the external wall of the pocket tube 76 laterally penetrate the valve housing cylinder 82. Not illustrated is a valve or plug element that is placed in the cylinder 82 by a wireline manipulated device called a "kickover" tool. For wellbore completion, side pocket mandrels are normally set with side pocket plugs in the cylinder 82. Such a plug interrupts flow through the apertures 86 between the mandrel interior flow channel and the exterior annulus and masks entry of the completion cement. After all completion procedures are accomplished, the plug may be easily withdrawn by wireline tool and replaced by a wireline with a fluid control element.

At the upper end of the mandrel 30 is a guide sleeve 88 having a cylindrical cam profile for orienting the kickover tool with the valve cylinder 82 in a manner well known to those of skill in the art.

Set within the pocket tube area between the side pocket cylinder 82 and the assembly joints 72 and 74 are two rows of filler guide sections 90. In a generalized sense, the filler guide sections 90 are formed to fill much of the unnecessary interior volume of the side pocket tube 76 and thereby eliminate opportunities for cement to occupy that volume. Of equal but less obvious importance is the filler guide section function of generating turbulent circulations within the mandrel voids by the working fluid flow behind the wiper plug.

Similar to quarter-round trim molding, the filler guide sections 90 have a cylindrical arcuate surface 92 and intersecting planar surfaces 94 and 96. The opposing face separation between the surfaces 94 is determined by clearance space required by the valve element inserts and the kick-over tool.

Surface planes 96 serve the important function of providing a lateral supporting guide surface for a wiper plug as it traverses the side pocket tube 76 and keep the leading wiper elements within the primary flow channel 84.

At conveniently spaced locations along the length of each filler section, cross flow jet channels 97 are drilled to intersect from the faces 94 and 96. Also at conveniently spaced locations along the surface planes 94 and 96 are indentations or upsets 98. Preferably, adjacent filler guide sections 90 are separated by spaces 99 to accommodate different expansion rates during subsequent heat treating procedures imposed on the assembly during manufacture. If deemed necessary, such spaces 99 may be designed to further stimulate flow turbulence.

Figure 8:
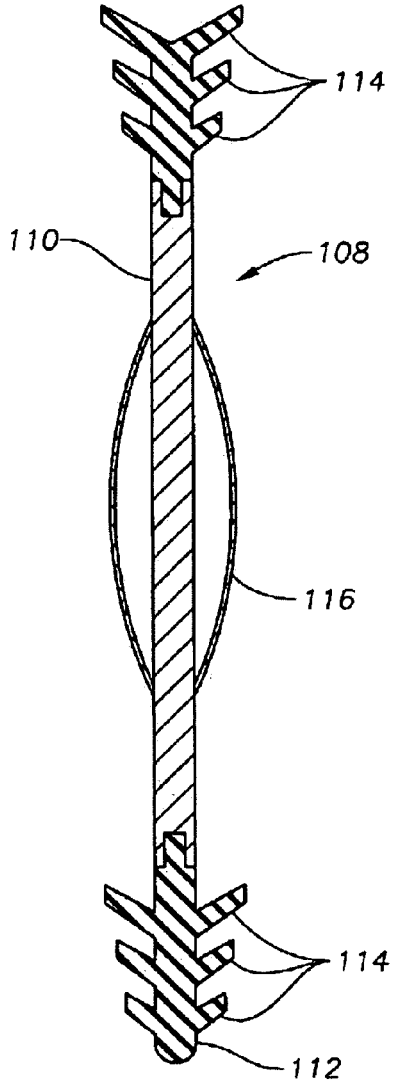
FIG. 8 is a detailed view of an exemplary wiper plug constructed in accordance with the present invention.

FIG. 8 schematically illustrates the wiper plug 108 utilized with the side pocket mandrel 30. A significant distinction this wiper plug 108 makes over similar prior art devices is the length. The plug 108 length is correlated to the distance between the upper and lower assembly joints 72 and 74. Wiper plug 108 has a central shaft 110 with leading and trailing groups of nitrile wiper discs 114. As is apparent from FIG. 8, the leading group of wiper discs 114 is located proximate the nose portion 112 of the shaft 110, while the trailing group of discs 114 is located proximate the opposite, or rear, end of the shaft 110. Each of the discs 114 surround the shaft 110 and have radially extending portions designed to contact the flowbore 26 and wipe excess cement therefrom. It is also noted that the discs 114 are concavely shaped so that they may capture pressurized fluid from the rear of the shaft 110. Between the leading and trailing groups is a spring centralizer 116. The shaft 110 also has a nose portion 112.

As the leading wiper group of discs 114 enters the side pocket mandrel 30, fluid pressure seal behind the wiper discs 114 is lost but the filler guide planes 96 keep the leading wiper group 114 in line with the primary tubing flow bore 84 axis. The trailing group of discs 114 is, at the same time, still in a continuous section of tubing flow bore 84 above the side pocket mandrel 30. Consequently, pressure against the trailing group of discs 114 continues to load the plug shaft 110. As the wiper plug 108 progresses through a mandrel 30, the spring centralizer 116 maintains the axial alignment of the shaft 110 midsection. By the time the trailing disc group 114 enters the side pocket mandrel 30 to lose drive seal, the leading group of discs 114 has reentered the bore 84 below the mandrel 20 and regained a drive seal. Consequently, before the trailing seal group of discs 114 loses drive seal, the leading seal group of discs 114 have secured traction seal.

Figure 3:
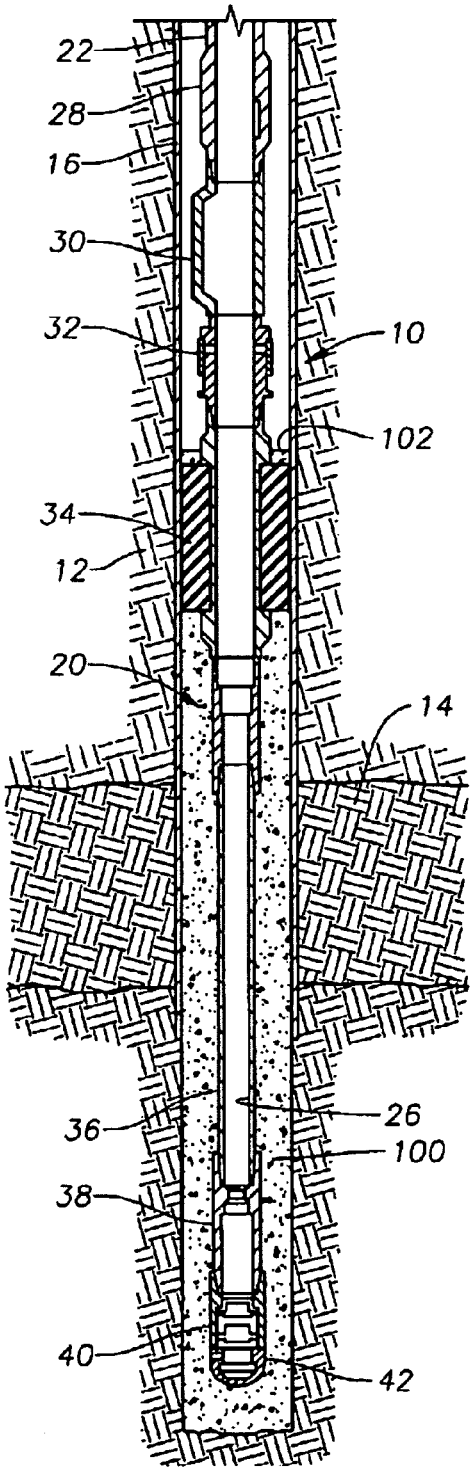
FIG. 3 is a side, cross-sectional view of the exemplary system depicted in FIGS. 1 and 2, now being shown following setting of a packer.
Figure 4:
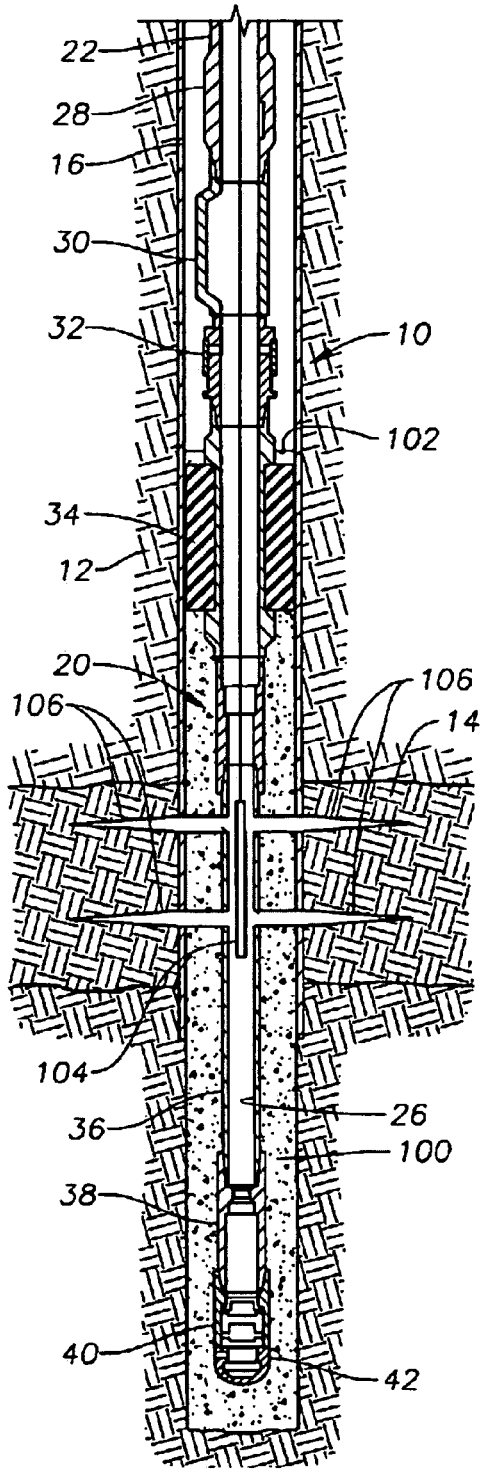
FIG. 4 is a side, cross-sectional view of the exemplary system depicted in FIGS. 1–3 after perforation of the formation.

Exemplary operation of the mono-trip completion system 20 is illustrated by FIGS. 1–7. In FIG. 1, the assembly 20 is shown after having been disposed into the wellbore 10 so that the production liner 36 is located proximate the formation 14. Once this is done, cement 100 is flowed downwardly through the central flowbore 26 and radially outwardly through the lateral openings 42 in the shoe track 40. Cement 100 fills the annulus 24 until a desired level 102 of cement 100 is reached for anchoring the system 20 in the wellbore 10. Typically, the desired level 102 of cement 100 will be such that portions of the packer assembly 34 are covered (see FIG. 2). The packer assembly 34 is then set within the wellbore 10, as illustrated by FIG. 3 to complete the anchorage. Next, a perforation device 104, of a type known in the art, is run into the flowbore 26, as illustrated in FIG. 4. The perforation device 104 is actuated to create perforations 106 in the casing 16 and surrounding formation 14. The perforation device 104 is then withdrawn from the flowbore 26. If desired, the packer assembly 34 may be set after the perforation device has been actuated and the cement cleaned from the system 20 in a manner which will be described shortly. Typically, the perforation device 104 is actuated to perforate the formation 14 after the cement 100 has been flowed into the wellbore 10 and the wiper plug 108 has been run into the flowbore 26, as will be described. Also, the cement 100 is typically provided time to set and cure somewhat before perforation.

Figure 5:
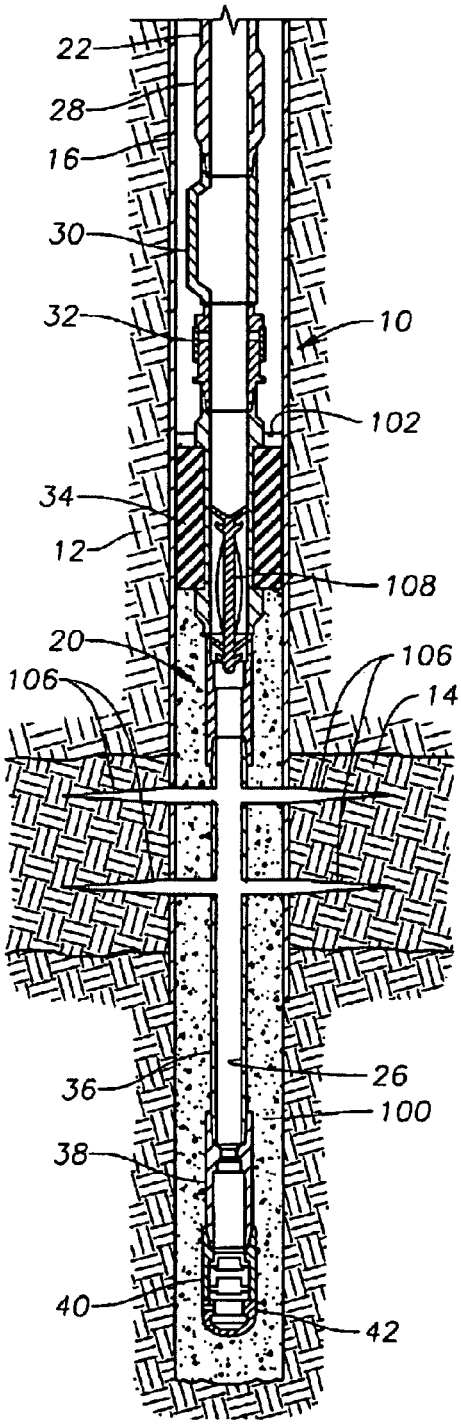
FIG. 5 is a side, cross-sectional view of the exemplary system depicted in FIGS. 1–4 now having a wiper plug pumped downward through the production system.
Figure 6:
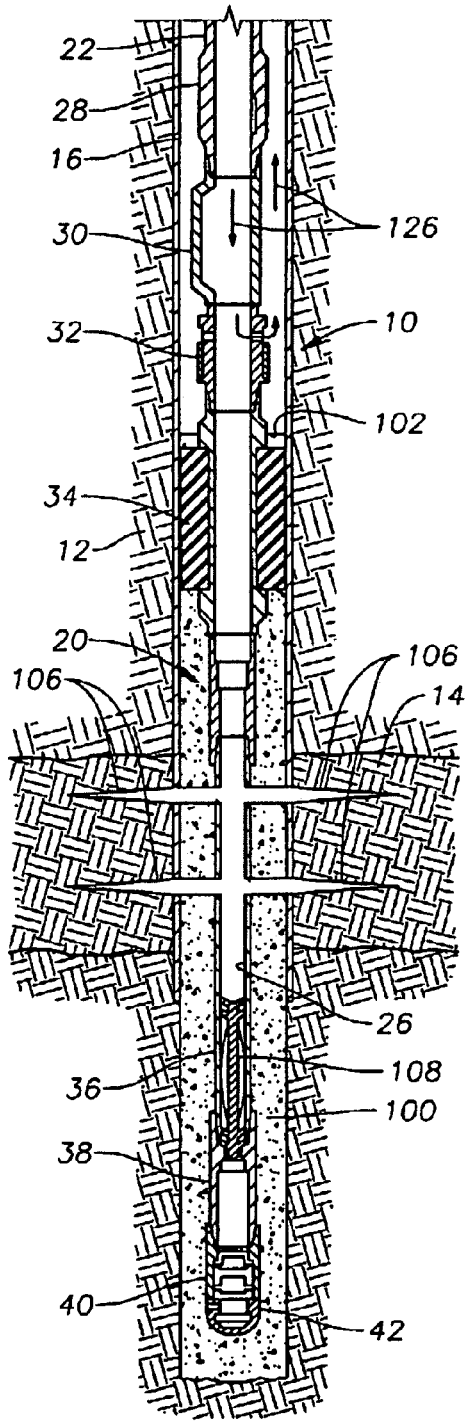
FIG. 6 is a side, cross-sectional view of the exemplary system shown in FIGS. 1–5 illustrating further cleaning of cement from the system.

Cement is cleaned from the system 20 by the running of a wiper plug 108 into the flowbore 26 to wipe excess cement from the flowbore 26 and the components making up the assembly 20. Thereafter, a working fluid is circulated through the assembly 20 to further clean the components. As FIG. 5, illustrates, the wiper plug 108 is inserted into the flowbore 26 and urged downwardly under fluid pressure. A working fluid is used to pump the wiper plug 108 down the flowbore 26. Fluid pressure behind the discs 114 will drive the wiper plug 108 downwardly along the flowbore 26. Along the way, the discs 114 will efficiently wipe cement from the flowbore 26. When the wiper plug 108 reaches the lower end of the flowbore 26, it will become seated in the landing collar 38, as illustrated in FIG. 6.

Figure 9:
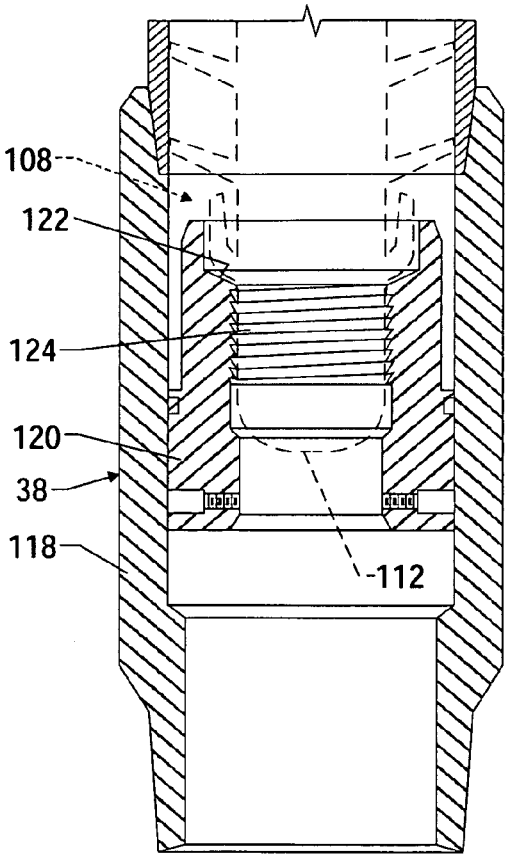
FIG. 9 is a detailed view of an exemplary landing collar having a wiper plug landed therein.

FIG. 9 illustrates in greater detail the seating arrangement of the wiper plug 108 in the landing collar 38. As shown there, the landing collar 38 includes an outer housing 118 that encloses an interior annular member 120. The annular member 120 provides an interior landing shoulder 122 and a set of wickers 124. The nose portion 112 of the wiper plug 108 lands upon the landing shoulder 122, which prevents the wiper plug 108 from further downward motion. The wickers 124 frictionally engage the nose portion 112 to resist its removal from the landing collar 38. Landing of the wiper plug 108 in the landing collar 38 will close off the lower end of the flowbore 26 to further fluid flow outwardly via the shoe track 40.

Following landing of the wiper plug 108, the flowbore 26 is pressured up at the surface to a first pressure level that is sufficient to rupture the rupture disc 60 in the HCCV 32. Once the rupture disc 60 has been destroyed, working fluid can be circulated down the flowbore 26 and outwardly into the annulus 24, as indicated by arrows 126 in FIG. 6. The working fluid may then return to the surface of the wellbore 10 via the annulus 24. As the working fluid is circulated into the flowbore 26 to the HCCV 32, it is flowed through the side pocket mandrel 30. During this process, cement is cleaned from the system 20 by the flowing working fluid and, most particularly, from the side-pocket mandrel 30 that must be used for gas lift operations at a later point.

When sufficient cleaning has been performed, it is necessary to close the fluid port 58 of the HCCV 32. The annulus 24 should be closed off at the surface of the wellbore 10. Thereafter, fluid pressure is increased within the flowbore 26 and annulus 24 above the level 102 of the cement 100 via continued pumping of working fluid down the flowbore 26. Pumping of pressurized fluid should continue until a predetermined level of pressure is achieved. This predetermined level of pressure will shear the shear pin 66 and move the outer sleeve 62 to the closed position illustrated in FIG. 10B. The flowbore 26 can then be pressure tested for integrity. As described above, the inner sleeve 67 may be closed via a shifter tool 73 in the event that the outer sleeve 62 fails to close.

Figure 7:
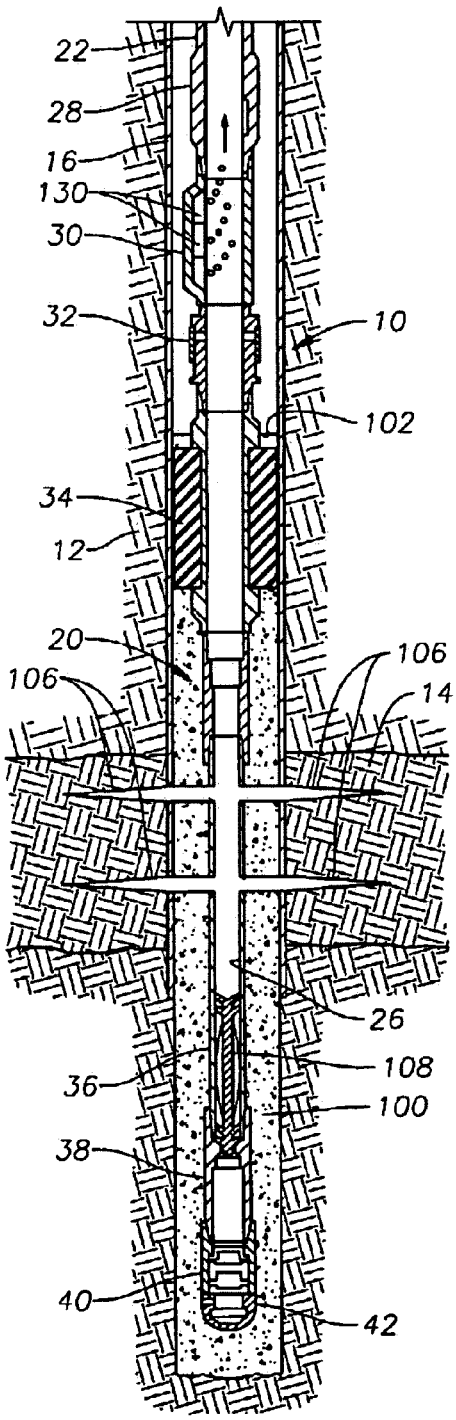
FIG. 7 is a side, cross-sectional view of the exemplary system shown in FIGS. 1–6 illustrating the placement of gas left valves within the gas lift mandrel for subsequent production of hydrocarbon fluids.

FIG. 7 illustrates the addition of gas lift valves 130 into the side pocket mandrel 30 in completion system 20 in order to assist production of hydrocarbons from the formation 14. A kickover tool (not shown), of a type well known in the art, is used to dispose one or more gas lift valves 130 into the cylinder 82 of the side pocket mandrel 30. Similarly, gas lift valves are well known to those of skill in the art and a variety of such devices are available commercially. Therefore, a discussion of their structure and operation is not being provided.

The gas lift valves 130 may be placed into the side pocket mandrel 30 and operable thereafter since the apertures 86 in the side pocket mandrel 30 should be substantially devoid of cement due to the measures taken previously to clean the completion system 20 of excess cement or prohibit clogging by cement. These measures, which greatly reduce the passage of gas through the flowobore 26, include the presence of side pocket plugs in the cylinder 82 of the side pocket mandrel 30 and filler guide sections 90. The filler guide sections 90 have features to stimulate flow turbulence, including cross-flow jet channels 97 and spaces 99 between the guide sections 90. In addition, circulation of the working fluid throughout the system 20, in the manner described above, will help to clean excess cement from the side pocket mandrel 30, and other system components, prior to insertion of the gas lift valves 130.

After the gas lift valves 130 are placed into the side pocket mandrel 30, hydrocarbon fluids may be produced from the formation 14 by the system 20. Fluids exit the perforations 106 and enter the perforated production liner 36. They then flow up the flowbore 26 and into the production tubing 22. The gas lift valves 130 inject lighter weight gases into the liquid hydrocarbons, in a manner known in the art, to assist their rise to the surface of the wellbore 10.

The systems and methods of the present invention make it possible to secure a completion assembly 20 in place within a wellbore which will be suitable for later use in artificial lift operations. The side pocket mandrel 30, which will later receive the gas lift valves 130 is already a part of the completion assembly 20 during its initial (and only) run into the wellbore 10. The techniques described above for cleaning excess cement from the completion assembly 20 will effectively remove cement so that artificial lift valves 130 can be effectively used to help lift production fluids to the surface of the wellbore 10.

Those of skill in the art will recognize that numerous modifications and changes may be made to the exemplary designs and embodiments described herein and that the invention is limited only by the claims that follow and any equivalents thereof.

What is claimed is:

1. A completion system for production of hydrocarbons from a formation surrounding a wellbore, the completion system comprising:

a completion assembly for disposal into an annulus of a wellbore, the completion assembly defining a flowbore therewithin for flowing of fluid;

a valve assembly incorporated within the completion assembly having a flow port that may be moved between a substantially opened position and a substantially closed position to selectively provide fluid communication between the flowbore and the annulus;

a mandrel incorporated within the completion assembly and containing a cylinder for selective placement of a valve; and a valve shaped and sized to reside within the cylinder of the mandrel.

2. The completion system of claim 1 further comprising:

a landing collar incorporated within the completion assembly for seating of a wiper plug; and a wiper plug to be disposed within the flowbore of the completion assembly for cleaning of excess cement from components making up the completion assembly.

3. The completion system of claim 1 further comprising a packer incorporated within the completion assembly to assist in anchoring of the completion assembly within the wellbore.

4. The completion system of claim 1 wherein the valve assembly comprises:

a generally tubular mandrel;

a flow port within the mandrel;

a frangible rupture disc within the flow port for initially closing the flow port against fluid flow; and an outer sleeve surrounding the mandrel and being moveable between a first position, wherein the flow port is substantially open to fluid communication, and a second position, wherein the flow port is substantially closed to fluid communication.

5. The completion system of claim 2 wherein the wiper plug comprises:

a shaft having a nose portion;

a wiper disc affixed to the shaft and having radially extending portion to contact the flowbore and wipe excess cement therefrom.

6. The completion system of claim 5 further wherein the wiper plug further comprises a centralizer secured to the shaft.

7. The completion system of claim 5 wherein there is a plurality of wiper discs.

8. The completion system of claim 7 wherein at least one of said plurality of wiper discs is located as a leading wiper disc set proximate the nose portion and at least one of said plurality of discs is located as a trailing wiper disc set proximate a rear portion of the shaft.

9. The completion system of claim 2 wherein the landing collar presents a landing profile that is formed to receive a nose portion of the wiper plug.

10. A completion system for production of hydrocarbons from a formation surrounding a wellbore, the completion system comprising:

a completion assembly for disposal into an annulus of a wellbore, the completion assembly defining a flowbore therewith in for flowing of cement downwardly therethrough and hydrocarbons upwardly therethrough;

a device for cleaning excess cement from the completion assembly; and a gas lift valve that can be operably associated with the completion system after flowing of cement through the flowbore to selectively permit gas in the annulus to flow into the flowbore.

11. The completion system of claim 10 wherein the device for cleaning excess cement from the completion assembly comprises a wiper plug to be driven through the flowbore.

12. The completion system of claim 10 wherein the device for cleaning excess cement from the completion assembly comprises a valve assembly incorporated within the completion assembly having a flow port that may be moved between a substantially opened position and a substantially closed position to selectively provide fluid communication between the flowbore and the annulus.

13. The completion system of claim 10 further comprising a packer assembly to aid in securing the completion assembly within a wellbore.

14. The completion system of claim 10 further comprising a shoe track proximate a lower end of the flowbore.

15. The completion system of claim 11 further comprising a landing collar incorporated into the completion system for landing of the wiper plug within the completion system.

16. A method of completing a subterranean well for gas lifted fluid extraction comprising the steps of:

a. positioning within a well bore a production tubing string having at least one mandrel assembled within said tubing string;

b. displacing cement through a flow bore of said tubing string into a wellbore annulus around a portion of said tubing string below said mandrel; and c. creating openings in said tubing portion and surrounding cement to admit formation fluid flow into said flow bore; and d. admitting gas from a wellbore annulus into the flowbore via the at least one mandrel.

17. A method of completing a well as described by claim 16 wherein said cement is displaced through at least one side pocket mandrel.

18. A method of completing a well as described by claim 16 wherein said cement is displaced by pressurized well working fluid driven behind a cement wiper plug.

19. A method of completing a well as described by claim 18 wherein said well working fluid behind said wiper plug substantially removes cement remaining within said mandrel.

20. A method of completing a well as described by claim 16 further comprising the step of charging said wellbore above said cement with pressurized gas.

21. A method of completing a well as described by claim 16 further comprising the step of admitting said pressurized gas into said flow born through said mandrel to extract fluids from said formation.

22. A method for production of hydrocarbons from a formation proximate a wellbore comprising the steps of:

disposing a completion assembly into a wellbore, said completion assembly having a flowbore defined therewithin;

pumping cement through the flowbore of the completion assembly to fill a portion of an annulus surrounding the completion assembly;

closing a lower end of the flowbore against fluid flow;

cleaning excess cement from the completion assembly;

opening a portion of the completion assembly so that hydrocarbon fluids from the formation may enter the flowbore; and assisting production of said hydrocarbon fluids from said flowbore using an artificial lift pump that flows gas into the annulus.

23. The production method of claim 22 wherein the step of closing a lower end of the flowbore further comprises landing a wiper plug within the flowbore.

24. The production method of claim 22 wherein the step of cleaning excess cement from the completion assembly comprises disposing a wiper plug through the flowbore to wipe excess cement from components of the production assembly.

25. The production method of claim 22 wherein the step of cleaning excess cement from the completion assembly comprises selectively circulating working fluid through the flowbore and into the annulus.

26. The production method of claim 25 wherein the step of selectively circulating working fluid through the flowbore and into the annulus further comprises rupturing a rupture disc to substantially open a flow port in a valve assembly.

27. The production method of claim 22 wherein the step of selectively circulating working fluid through the flowbore and into the annulus further comprises sliding a sleeve member to block fluid flow through the flow port.

* * * * *